US010406668B2

(12) United States Patent
Weber et al.

(10) Patent No.: US 10,406,668 B2
(45) Date of Patent: Sep. 10, 2019

(54) HANDHELD POWER TOOL

(71) Applicant: Hilti Aktiengesellschaft, Schaan (LI)

(72) Inventors: Michael Weber, Eichenau (DE); Stefan Schmid, Untermuehlhausen (DE); Markus Holubarsch, Karlsruhe (DE); Axel Fischer, Wiedergeltingen (DE)

(73) Assignee: Hilti Aktiengesellschaft, Schaan (LI)

( * ) Notice: Subject to any disclaimer, the term of this patent is extended or adjusted under 35 U.S.C. 154(b) by 508 days.

(21) Appl. No.: 14/915,850

(22) PCT Filed: Sep. 2, 2014

(86) PCT No.: PCT/EP2014/068571
§ 371 (c)(1),
(2) Date: Mar. 1, 2016

(87) PCT Pub. No.: WO2015/036279
PCT Pub. Date: Mar. 19, 2015

(65) Prior Publication Data

US 2016/0207188 A1 Jul. 21, 2016

(30) Foreign Application Priority Data

Sep. 12, 2013 (EP) ..... 13184071

(51) Int. Cl.
*B25D 17/24* (2006.01)
*B25D 17/04* (2006.01)
*B25F 5/00* (2006.01)

(52) U.S. Cl.
CPC ..... *B25D 17/043* (2013.01); *B25D 17/24* (2013.01); *B25F 5/006* (2013.01); *B25D 2211/068* (2013.01); *B25D 2250/371* (2013.01)

(58) Field of Classification Search
CPC ..... B25D 17/24; B25D 2250/371; B25D 17/043; B25D 2217/0092
(Continued)

(56) References Cited

U.S. PATENT DOCUMENTS 5,025,870 A 6/1991 Gantner
7,513,317 B2 * 4/2009 Satou ..... B25D 17/24 173/109
(Continued)

FOREIGN PATENT DOCUMENTS

CN 1411959 A 4/2003
CN 1460049 A 12/2003
(Continued)

*Primary Examiner* — Andrew M Tecco
*Assistant Examiner* — Eyamindae C Jallow
(74) *Attorney, Agent, or Firm* — Davidson, Davidson & Kappel, LLC

(57) ABSTRACT

The handheld power tool has a tool socket to hold a chiseling tool on a working axis and a striking mechanism that acts upon the tool in the striking direction. The striking mechanism is arranged in a machine housing. A handle is oriented along a handle axis that is perpendicular to the working axis and that is installed on the machine housing by three suspension assemblies. The second suspension assembly has a lever arm that runs along the handle axis. The first end of the lever arm is attached to a machine housing and to a handle. A guide is attached to the other machine housing and handle. The second end of the lever arm in the guide can be forcibly deflected against a spring along a trajectory that is slanted or perpendicular to the working axis.

6 Claims, 1 Drawing Sheet

(58) Field of Classification Search
USPC ..... 173/162.1, 162.2
See application file for complete search history.

(56) References Cited

U.S. PATENT DOCUMENTS

| | | | | |
|---|---|---|---|---|
| 7,766,096 | B2 * | 8/2010 | Satou | B25D 17/24 173/109 |
| 7,802,632 | B2 | 9/2010 | Kristen et al. | |
| 7,987,921 | B2 | 8/2011 | Hahn et al. | |
| 8,261,854 | B2 * | 9/2012 | Kikuchi | B25D 17/24 173/109 |
| 8,443,912 | B2 | 5/2013 | Fischer et al. | |
| 2003/0070823 | A1 | 4/2003 | Kristen et al. | |
| 2003/0132016 | A1 | 7/2003 | Meixner et al. | |
| 2004/0040279 | A1 | 3/2004 | Groppi et al. | |
| 2004/0154813 | A1 * | 8/2004 | Daubner | B25D 17/24 173/162.2 |
| 2006/0086515 | A1 * | 4/2006 | Engelfried | B25D 17/043 173/162.2 |
| 2006/0185867 | A1 | 8/2006 | Frauhammer et al. | |
| 2006/0219418 | A1 * | 10/2006 | Arakawa | B25D 17/043 173/162.2 |
| 2008/0000664 | A1 | 1/2008 | Steinke | |
| 2012/0048580 | A1 * | 3/2012 | Appel | B25D 17/043 173/162.2 |
| 2012/0055689 | A1 * | 3/2012 | Wierer | B25D 17/043 173/162.2 |
| 2012/0125649 | A1 * | 5/2012 | Ohlendorf | B25D 17/24 173/162.2 |
| 2012/0267136 | A1 * | 10/2012 | Mossnang | B25D 17/24 173/162.2 |
| 2014/0326475 | A1 * | 11/2014 | Holubarsch | B25F 5/006 173/162.2 |

FOREIGN PATENT DOCUMENTS

| | | | |
|---|---|---|---|
| CN | 1463214 | A | 12/2003 |
| CN | 1502451 | A | 6/2004 |
| CN | 1820903 | A | 8/2006 |
| DE | 102004041219 | | 3/2006 |
| DE | 102010040094 | | 3/2012 |
| EP | 0370952 | | 5/1990 |
| EP | 1510300 | | 3/2005 |
| EP | 1880808 | | 1/2008 |
| EP | 2253430 | | 11/2010 |
| GB | 2171045 | | 8/1986 |
| GB | 2423273 | | 8/2006 |

* cited by examiner

HANDHELD POWER TOOL

The present invention relates to a handheld power tool for drilling tools, chiseling tools or combined drilling-chiseling tools. The handheld power tool comprises a striking mechanism against whose kickback effects the user is protected by means of vibration-damping decoupling elements situated between the striking mechanism and a handle.

BACKGROUND

When it comes to a handheld power tool whose center of mass is outside of the working axis, the kickback effects that act along the working axis also create a torque around the center of mass. U.S. Pat. Nos. 8,443,912 and 7,987,921 address this problem and propose that the handle be rotatably suspended around the center of mass so that the torque cannot act upon the handle.

SUMMARY OF THE INVENTION

The present invention provides a tool socket to hold a chiseling tool, drilling tool or combined drilling-chiseling tool, and it also has a striking mechanism. The striking mechanism is arranged in a machine housing. A handle is oriented along a handle axis that is slanted, namely, by at least 70°, or that is perpendicular to the working axis, and it is installed on the machine housing by means of three suspension assemblies. The first suspension assembly is arranged closer to the working axis than the second suspension assembly. The third suspension assembly is arranged offset with respect to the first suspension assembly and to the second suspension assembly along the working axis, for example, in the striking direction. The second suspension assembly has a lever arm that runs along the handle axis. The first end of the lever arm is attached to one of a machine housing and handle. A guide is attached to the other of the machine housing and handle. The second end of the lever arm in the guide can be forcibly deflected against a spring means along a trajectory that is slanted or perpendicular to the working axis.

The arrangement comprising the three suspension assemblies is particularly well-suited for a handheld power tool whose center of mass is outside of the working axis. The first suspension assembly can be situated closer to the working axis than the second suspension assembly.

By means of the guide, the second suspension assembly isolates the vibration damping along the handle axis from the requisite connection along the working axis. The spring means and the lever arm can be configured independently of each other in order to optimize the vibration damping in the individual directions. One configuration provides for the second end of the lever arm to be provided with a pivot bearing for purposes of further decoupling. The lever arm can be configured as a leaf spring which, for geometrical reasons, has a high stiffness along the handle axis and a low stiffness along the working axis.

One embodiment provides for the third suspension assembly to have a pivot bearing that can be moved parallel to the working axis in a linear guide and whose rotational axis is perpendicular to a plane formed by the working axis and the handle axis. The third suspension assembly allows the handle to move freely along the working axis in order to damp the kickback. The pivot bearing reduces the transmission of the torque of the handheld power tool around its center of mass. The guide only allows the machine housing to be moved relative to the handle parallel to the working axis. The pivot bearing augments the translatory degree of freedom of the guide by one rotatory degree of freedom, although the rotational axis of the pivot bearing remains inside the guide. Other translatory or rotatory movements are suppressed by the third suspension assembly.

The third suspension assembly can be advantageously arranged at the height of the intermediate striker. The striking mechanism has a striker and an intermediate striker arranged consecutively on the working axis in the striking direction. The intermediate striker is situated between the striker and the tool. The intermediate striker is typically located along the working axis well behind the center of mass as seen from the handle. With the arrangement of the third suspension assembly outside of the center of mass, vibrations that occur in heavy handheld drilling and chiseling hammer drills weighing, for example, 10 kg can be reduced to a far greater extent than if the suspension assembly is located on the center of mass.

BRIEF DESCRIPTION OF THE DRAWINGS

The description below explains the invention on the basis of embodiments and figures provided by way of an example. The figures show the following.

Unless otherwise indicated, identical or functionally identical elements are designated in the figures by the same reference numerals.

DETAILED DESCRIPTION

Figure 1:
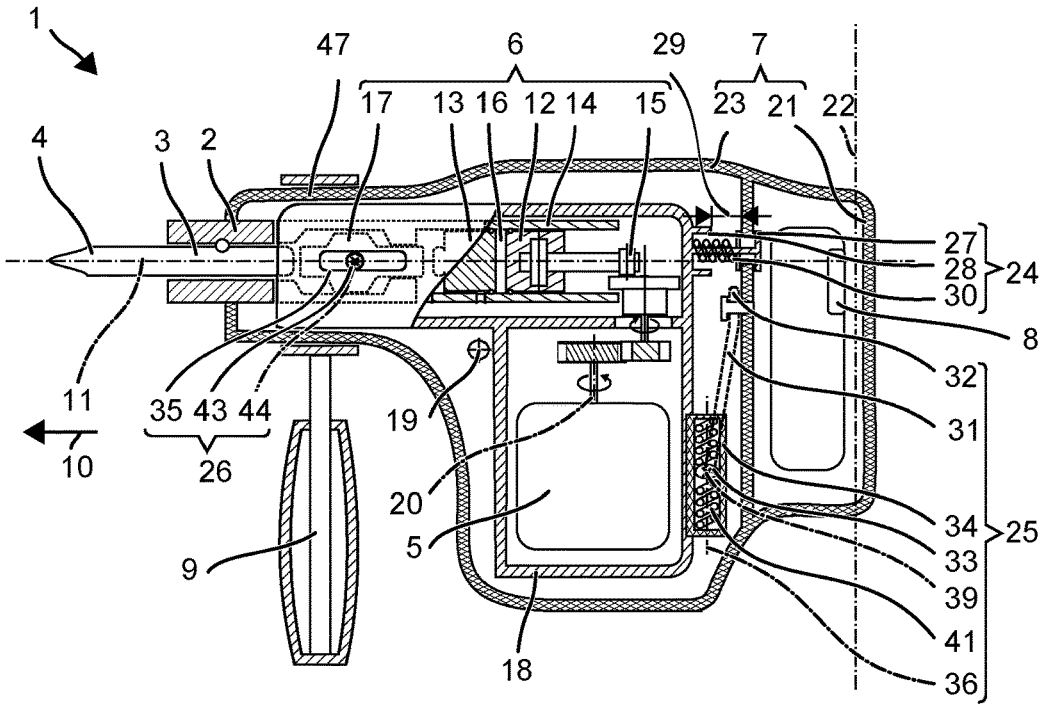
FIG. 1: a chiseling hammer drill.

FIG. 1 schematically shows a chiseling hammer drill 1 as an example of a chiseling handheld power tool. The chiseling hammer drill 1 has a tool socket 2 into which one shaft end 3 of a tool, for example, one of the chisels 4, can be inserted. A primary drive of the chiseling hammer drill 1 is in the form of a motor 5 which drives a striking mechanism 6 and optionally a driven shaft. The user can guide the chiseling hammer drill 1 by means of a handle 7 and can put the chiseling hammer drill 1 into operation by means of a system switch 8. An extra handle 9 is arranged around or near the tool socket 2. During operation, the chiseling hammer drill 1 continuously strikes the chisel 4 into a substrate in the striking direction 10 along the working axis 11. The tool socket 2 can be additionally driven by the motor 5 so as to rotate around the working axis 11.

The striking mechanism 6 is, for instance, a pneumatic striking mechanism 6. An exciter 12 and a striker 13 are installed in the striking mechanism 6 along the working axis 11 in such a way that they can move in a guide tube 14. The exciter 12 is coupled to the motor 5 by means of a cam 15 or a toggle element, and it is forced to execute a periodical, linear movement. An air cushion formed by a pneumatic chamber 16 between the exciter 12 and the striker 13 couples a movement of the striker 13 to the movement of the exciter 12. The striker 13 indirectly transmits part of its pulse to the drilling chisel 4 via an intermediate striker 17 that is essentially at rest during operation.

The motor 5, the striking mechanism 6 and additional drive components of the chiseling hammer drill 1 are arranged in a contiguous, single-part or multi-part machine housing 18. Due to the non-axial arrangement of the motor 5 outside of the operating axis 11, the center of mass 19 of the machine housing 18 containing the drive components 5, 6 is on the side of the motor 5. A motor axis 20 is outside of the operating axis 11, and the two axes 11, 20 form a plane that is referred to below as the main plane. The two axes 11, 20 can be slanted relative to each other, for example, they can be perpendicular to each other.

The handle 7 has a grip 21 which is to be gripped and whose axis 22 (handle axis) is largely perpendicular to the working axis 11. The handle axis 22 is preferably in the main plane with the working axis 11 and the motor axis 20. The grip 21 is arranged in front of the striking mechanism 6 as seen in the striking direction 10. The working axis 11 runs through the grip 21 so that the user can apply contact pressure on the working axis 11 into the chiseling hammer drill 1 and consequently into the chisel 4. The grip 21 can be arranged asymmetrically with respect to the working axis 11. The middle of the grip 21 is offset along the handle axis 22 from the working axis 11 towards the center of mass 19. For instance, the middle can be along the handle axis 22 at the height of the center of mass 19. The grip 21 can have an ergonomic surface that conforms to the palm of the hand.

The handle 7 provided by way of an example has a housing shell 23. The housing shell 23 surrounds the entire machine housing 18, except for an opening for the tool socket 2 and, if applicable, small cutouts for operating elements and ventilation openings.

The handle 7 is attached to the machine housing 18 by means of three suspension assemblies 24, 25, 26. These three suspension assemblies 24, 25, 26 allow the machine housing 18 to be guided by the handle 7. The suspension assemblies 24, 25, 26 transmit the movements in the main plane from the machine housing 18 to the handle 7 and vice versa. A movement perpendicular to the main plane is preferably suppressed by one of the suspension assemblies 24, 25, 26 or else by surfaces of the machine housing 18 and the handle 7 that run parallel to the main plane and that touch each other.

The first suspension assembly 24 is arranged close to the working axis 11. In the case of the embodiment provided by way of an example, the first suspension assembly 24 is located on the side of the working axis 11 facing away from the center of mass 19. The first suspension assembly 24 is preferably arranged in front of the machine housing 18 as seen in the striking direction 10. The first suspension assembly 24 preferably has a purely non-positive coupling, at least in the planes that are parallel to the main plane.

The handle 7 can be moved in the first suspension assembly 24 along the working axis 11 with respect to the machine housing 18. Stops 27, 28 in as well as opposite from the striking direction 10 limit the movement to a lift height 29. The handle 7 can also move with respect to the machine housing 18 along the handle axis 22 in the first suspension assembly 24.

The first suspension assembly 24 has a spring element 30 that transmits a contact pressure parallel to the working axis 11 between the handle 7 and the machine housing 18. For example, a helical spring oriented parallel to the working axis 11 can be clamped between the machine housing 18 and the handle 7. The helical spring is preferably used to transmit the high contact pressure. The spring element 30 can consist of several helical springs oriented in parallel. The helical spring given by way of an example is affixed at one end along the handle axis 22, here the end that is supported on the machine housing 18 along the working axis 11. The other end, here the end that is supported on the handle 7, can slide along the handle axis 22. As an alternative, the helical spring can be affixed at both ends, whereby in this case, due to the selected spring geometry, the transverse stiffness should be chosen so as to be low relative to the longitudinal stiffness of the helical spring.

The spring element 30 and the first suspension assembly 24 can preferably transmit only a low force along the handle axis 22 in comparison to a force along the working axis 11. The stiffness of the helical spring given by way of an example crosswise to the working axis 11 is smaller by at least one order of magnitude than its stiffness along the working axis 11.

The spring element 30 can be provided with a pre-tension along the working axis 11 in such a way that the handle 7 is pressed away from the machine housing 18 opposite to the striking direction 10.

The second suspension assembly 25 is arranged offset to the first suspension assembly 24 along the handle axis 22. In the case of the preferred configuration, the second suspension assembly 25 is situated on the side of the working axis 11 facing the center of mass 19. The second suspension assembly 25 preferably has a purely non-positive coupling, at least in the plane parallel to the main plane.

The second suspension assembly 25 transmits a crosswise force perpendicular to the working axis 11 between the handle 7 and the machine housing 18. The second suspension assembly 25 can exert and transmit a force parallel to the working axis 11 between the machine housing 18 and the handle 7. The second suspension assembly 25 is preferably arranged in front of the machine housing 18 as seen in the striking direction 10.

The second suspension assembly 25 has a lever arm 31 whose first end 32 is rigidly attached to the handle 7 and whose second end 33 is movably suspended in a guide 34 along a trajectory. The guide 34 is attached to the machine housing 18. The second suspension assembly 25 can likewise be attached via the guide 34 to the handle 7, and via the first end 31 of the lever arm 31 to the machine housing 18.

The lever arm 31 is oriented essentially along the handle axis 22. The lever arm 31 is slanted vis-à-vis the working axis 11, for example, by between 70° and 90°. The end attached to the handle 7, here the first end 32, is situated closer to the working axis 11 than the second end 33 is. The lever arm 31 is preferably configured as a leaf spring. The lever arm 31 is virtually rigid in a direction parallel to the handle axis 22, in other words, when it is under a compressive and tractive load. In contrast, the lever arm 31 is elastically resilient parallel to the working axis 11, that is to say, when it is under a flexural load.

Figure 2:
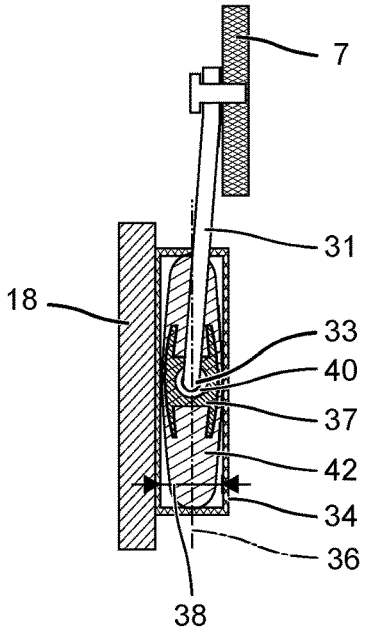
FIG. 2: a suspension assembly.

The trajectory 36 of the guide 34 is, for instance, rectilinear and slanted with respect to the working axis 11. Preferably, the slant of the guide 34 vis-à-vis the axis 22 is between 45° and 90°, for example, between 70° and 90°. In the case of movements of the machine housing 18 relative to the handle 7 along the trajectory 36, the guided end 33 of the lever arm 31 can be forced to follow these movements on the trajectory 36. The trajectory can be rectilinear, as shown. A curved trajectory 36 can be advantageous so that, to the greatest extent possible, the right angle can be retained between the working axis 34 and the handle axis 22 in case of spring movements due to the forward force and due to the dynamic deflections. For instance, the guide 34 has a carriage 37 whose outer dimension perpendicular to the trajectory 36 is equal to the inner dimension 38 of the guide 34. The suspended end 33 can be suspended in the guide 34 in such a way that it can swivel around a rotational axis 39 that runs through the end 33 and that is perpendicular to the main plane. In the embodiment shown in FIG. 2, the carriage 37 is provided with a pivot bearing 40 on which the end 33 is rotatably suspended.

The second suspension assembly 25 can be a spring mechanism 41 that exerts a returning force against a deflection of the guided end 33 out of its basic position. In this manner, in case of high forces along the handle axis 22, the deflection of the carriage 37 vis-à-vis the guide 34 is kept small, thus enhancing the guiding properties of the drilling or chiseling hammer drill. The spring mechanism 41 can have, for instance, springs made of an elastomer 42, foam, leaf springs or helical springs. The use of progressive spring elements has the advantage that the function is retained in case of high forces along the handle axis 22, even if the size of the gap between the device housing 23 and the machine housing 18 is small. As shown, the spring mechanism 41 can be spatially arranged in the guide 34 or else outside of the guide 34.

Due to the guide 34, the spring mechanism 41 is only loaded along the trajectory 36 and it can be configured correspondingly independently. A force being exerted on the second suspension assembly 25, for instance, due to a torque acting on the center of mass 19, is divided by the guide 34 into a first component along the trajectory 36 and a second component parallel to the working axis 11. The spring mechanism 41 damps the first component, whereas the lever arm 31 essentially exerts no influence on it. The lever arm 31 can damp the second component. A spring constant of the lever arm 31 that acts parallel to the working axis 11 can be smaller by one order of magnitude than a spring constant of the spring element 30 of the first suspension assembly 24 that acts parallel to the working axis 11. For this reason, the second component is transmitted mainly via the first suspension assembly 24 between the machine housing 18 and the handle 7.

The lever arm 31 can be provided with a pre-tension that pulls the handle 7 in the striking direction 10 towards the machine housing 18. Therefore, the pre-tensioning of the lever arm 31 counters the pre-tensioning in the first suspension 24. The pre-tensioning of the lever arm 31 is preferably eliminated if, during operation, the user presses the handheld power tool in the striking direction 10 by between 25% and 75% of the lift height 29, which is the case during normal operation. Owing to the pre-tensioning, the gap between the housing shell 23 and the machine housing 18 in the working direction can be kept small, which saves installation space.

The third suspension assembly 26 is arranged along the working axis 11 at the height of the intermediate striker 17. The center of mass 19 of the machine housing 18 is in front of the third suspension assembly 26 as seen in the striking direction 10, typically by more than 20% of the distance between the first suspension assembly 24 and the third suspension assembly 26. Preferably, the third suspension assembly 26 is in a plane with the working axis 11. The third suspension assembly 26 connects the machine housing 18 to the handle 7 via a pivot bearing 43 inserted into a linear guide 35. A rotational axis 44 of the pivot bearing 43 is perpendicular to the main plane that is formed by the working axis 11 and the handle axis 22. The rotational axis 44 is offset with respect to the center of mass 19 of the machine housing 18 in the striking direction 10. The linear guide 35 runs parallel to the working axis 11. Therefore, the machine housing 18 can be moved parallel to the working axis 11 so as to pivot around the rotational axis 44 with respect to the handle 7.

The linear guide 35 can be formed, for example, by an elongated groove in the machine housing 18 running parallel to the working axis 11. The groove has a length, for instance, of 1 cm to 2 cm, which corresponds approximately to the lift height 29 of the first suspension assembly 24. The handle 7 has, for example, a cylindrical journal that engages with the groove. The journal can rotate inside the groove around its axis that forms the rotational axis 14. In an analogous manner, the journal can be provided on the machine housing 18 and the groove in the handle 7.

Figure 3:
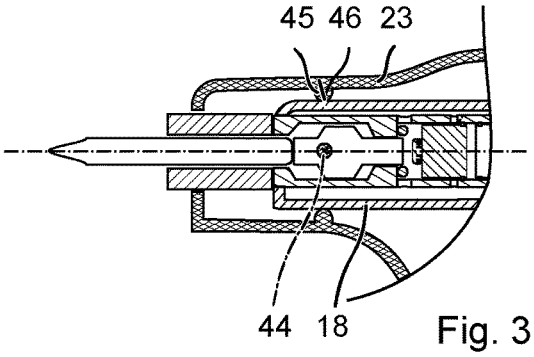
FIG. 3: a suspension assembly.

The third suspension assembly 26 can be formed by a ring 45 on the handle 7 in which the machine housing 18 is inserted so as to be axially movable (FIG. 3). The inner surface 46 of the ring 45 is curved so as to be convex. When the machine housing 18 is hanging in the ring 45, it can tilt vis-à-vis the latter around the rotational axis 39. The rotational axis 39 runs through the center of the ring 45.

The closed housing shell 23 of the handle 7 can have a cylindrical section 47 near the tool socket 2. The extra grip 9 can be attached to the cylindrical section 47. The extra grip 9 can preferably be detached from the housing shell 23 without the use of a tool, for instance, in order to re-orient the extra grip 9 with respect to the handle axis 22. By means of the three suspension assemblies 24, 25, 26 of the handle 7, the extra grip 9 is suspended indirectly on the machine housing 18 so that vibrations are damped.

What is claimed is:

1. A handheld power tool comprising:

a tool socket to hold a tool on a working axis;

a striking mechanism having a striker on the working axis acting upon the tool in the striking direction;

a handle oriented along a handle axis and slanted toward the working axis and installed on a machine housing via first, second and third suspension assemblies, the first suspension assembly arranged closer to the working axis than the second suspension assembly, the third suspension assembly arranged offset with respect to the first suspension assembly and to the second suspension assembly along the working axis, the second suspension assembly having a lever arm running along the handle axis, the lever arm having a first end attached to one of the machine housing and the handle, and the second suspension assembly having a guide attached to the other one of the machine housing and the handle to which the first end is not attached, a second end of the lever arm in the guide forcibly deflectable against a spring along a trajectory slanted or perpendicular to the working axis, wherein the third suspension has a linear guide parallel to the working axis as well as a pivot bearing arranged in the linear guide and whose rotational axis is perpendicular to a plane formed by the working axis and the handle axis.

2. The handheld power tool as recited in claim 1 wherein the working axis and the rotational axis are in one plane.

3. The handheld power tool as recited in claim 1 wherein the third suspension assembly is arranged along the working axis at the height of an intermediate striker.

4. A handheld power tool comprising:

a tool socket to hold a tool on a working axis;

a striking mechanism having a striker on the working axis acting upon the tool in the striking direction;

a handle oriented along a handle axis and slanted toward the working axis and installed on a machine housing via first, second and third suspension assemblies, the first suspension assembly arranged closer to the working axis than the second suspension assembly, the third suspension assembly arranged offset with respect to the first suspension assembly and to the second suspension assembly along the working axis, the second suspension assembly having a lever arm running along the handle axis, the lever arm having a first end attached to one of the machine housing and the handle, and a guide attached to the other one of the machine housing and the handle to which the first end is not attached, a second end of the lever arm in the guide forcibly deflectable against a spring along a trajectory slanted or perpendicular to the working axis; wherein the third suspension has a linear guide parallel to the working axis as well as a pivot bearing arranged in the linear guide and whose rotational axis is perpendicular to a plane formed by the working axis and the handle axis.

5. The handheld power tool as recited in claim 4 wherein the working axis and the rotational axis are in one plane.

6. The handheld power tool as recited in claim 4 wherein the third suspension assembly is arranged along the working axis at the height of an intermediate striker.

* * * * *